United States Patent [19]

Morris

[11] Patent Number: 4,940,518

[45] Date of Patent: Jul. 10, 1990

[54] COMBINATION SEAL MEMBER AND MEMBRANE HOLDER FOR A FILTER PRESS TYPE ELECTROLYTIC CELL

[75] Inventor: Gregory J. E. Morris, Milan, Italy

[73] Assignee: The Dow Chemical Company, Midland, Mich.

[21] Appl. No.: 249,638

[22] Filed: Sep. 26, 1988

[51] Int. Cl.[5] ..... C25B 1/24; C25B 9/00; C25B 13/00

[52] U.S. Cl. ..... 204/128; 204/252; 204/253; 204/256; 204/258; 204/266; 204/279; 277/206 R

[58] Field of Search ..... 277/206 R, 205, 207 R; 204/279, 253–258; 210/227, 229, 321.84

[56] References Cited

U.S. PATENT DOCUMENTS

| | | | |
|---|---|---|---|
| 1,721,407 | 7/1929 | Pechkranz | 204/254 |
| 2,306,160 | 12/1942 | Freyssinet | 277/34.3 |
| 3,378,480 | 4/1968 | Reishagen et al. | 204/253 |
| 3,761,099 | 9/1973 | Hansson | 277/206 R |
| 3,857,773 | 12/1974 | DuBois et al. | 204/256 X |
| 3,869,375 | 3/1975 | Ono et al. | 204/279 X |
| 3,964,932 | 6/1976 | Oltman et al. | 429/185 |
| 4,013,535 | 3/1977 | White | 204/252 |
| 4,026,782 | 5/1977 | Bouy et al. | 204/254 |
| 4,076,609 | 2/1978 | Mas | 204/258 |
| 4,098,670 | 7/1978 | Custer et al. | 204/252 |
| 4,107,023 | 8/1978 | Mentz | 204/269 |
| 4,111,779 | 9/1978 | Seko et al. | 204/255 |
| 4,137,144 | 1/1979 | Kenney | 204/268 |
| 4,139,448 | 2/1979 | Wallace | 204/256 |
| 4,175,024 | 11/1979 | Darlington | 204/252 |
| 4,175,025 | 11/1979 | Creamer et al. | 204/253 |
| 4,188,464 | 2/1980 | Adams et al. | 429/210 |
| 4,191,627 | 3/1980 | Specht | 204/296 |
| 4,197,206 | 4/1980 | Karn | 204/253 X |
| 4,207,165 | 6/1980 | Mose et al. | 204/258 |
| 4,217,200 | 8/1980 | Kedem et al. | 204/301 |
| 4,219,394 | 8/1980 | Babinsky et al. | 204/98 |
| 4,253,932 | 3/1981 | Mose et al. | 204/253 |
| 4,268,372 | 5/1981 | Iizima et al. | 204/252 |
| 4,268,373 | 5/1981 | Iizima et al. | 204/252 |
| 4,274,928 | 6/1981 | Cunningham | 204/98 |
| 4,279,731 | 7/1981 | Pellegri | 204/254 |
| 4,290,874 | 9/1981 | McMonigle et al. | 204/279 X |
| 4,313,812 | 2/1982 | Kircher | 204/253 |
| 4,332,661 | 6/1982 | Ford et al. | 204/253 |
| 4,342,460 | 8/1982 | Eng | 204/279 |
| 4,344,633 | 8/1982 | Niksa | 277/228 |
| 4,381,984 | 5/1983 | Kircher | 204/258 |
| 4,390,408 | 6/1983 | Kircher | 204/284 |
| 4,431,502 | 2/1984 | Ford | 204/252 |
| 4,441,977 | 4/1984 | Ford | 204/252 |
| 4,470,608 | 9/1984 | Warren | 277/164 |
| 4,488,946 | 12/1984 | Morris et al. | 204/98 |
| 4,490,231 | 12/1984 | Boulton | 204/263 |
| 4,493,759 | 1/1985 | Boulton et al. | 204/252 |
| 4,585,527 | 4/1986 | Northway et al. | 204/1 R |
| 4,595,208 | 6/1986 | Jönsson et al. | 277/206 R |
| 4,604,331 | 8/1986 | Louis | 429/35 |
| 4,610,765 | 9/1986 | Beaver et al. | 204/128 |
| 4,623,599 | 11/1986 | Vourlis | 429/174 |
| 4,638,109 | 1/1983 | Ford | 204/253 |
| 4,648,953 | 3/1987 | Wardle et al. | 204/237 |
| 4,654,134 | 3/1987 | Morris et al. | 204/252 |
| 4,656,104 | 4/1987 | Tucholski | 429/185 |
| 4,721,555 | 1/1988 | Grosshandler | 204/252 |
| 4,738,905 | 4/1988 | Collins | 429/36 |
| 4,748,092 | 5/1988 | Hekal | 429/35 |
| 4,776,940 | 10/1988 | Andres et al. | 204/279 X |

FOREIGN PATENT DOCUMENTS

| | | |
|---|---|---|
| 0051380 | 5/1982 | European Pat. Off. . |
| 0080288 | 11/1982 | European Pat. Off. . |
| 0118973 | 1/1984 | European Pat. Off. . |
| 2821983 | 11/1979 | Fed. Rep. of Germany . |
| 53-363284 | 6/1978 | Japan . |
| 53-146272 | 12/1978 | Japan . |
| 56-38484 | 4/1981 | Japan . |
| 58-4926 | 1/1983 | Japan . |
| 58-35272 | 8/1983 | Japan . |
| 1082867 | 3/1984 | U.S.S.R. . |
| 1078129 | 12/1964 | United Kingdom . |
| 1192245 | 5/1970 | United Kingdom . |
| 2013242 | 8/1979 | United Kingdom . |

*Primary Examiner*—Donald R. Valentine

*Attorney, Agent, or Firm*—Joe R. Prieto; John L. Wood

[57] ABSTRACT

A combination electrolysis cell gasket member and membrane holding member suitable for use in an electrolytic cells of the filter press type including a solid structure in a picture frame type configuration having an inside and outside perimeter surface, said solid structure having a groove in the outside perimeter surface forming a U-shaped member when viewed in cross section and adapted for holding the edges of a sheet-like member therein. Aqueous alkali metal chloride solution may be electrolyzed in the electrolytic cell.

11 Claims, 2 Drawing Sheets

COMBINATION SEAL MEMBER AND MEMBRANE HOLDER FOR A FILTER PRESS TYPE ELECTROLYTIC CELL

BACKGROUND OF THE INVENTION

This invention relates to a combination electrolysis cell sealing means and separator holding means for a filter press type electrolytic cell, and more particularly, to a combination electrolysis gasket member and membrane holding device for use in filter press type electrolytic cells.

Electrolytic cells of the filter press type are known to be used for the electrolysis of aqueous salt solutions and have been commercially employed for the production of chlorine and caustic from brine. The filter press type electrolytic cell for electrolysis of an aqueous salt solution commonly employ a plurality of frame members with electrodes held thereto and assembled in filter press type arrangement, separated from each other by membranes, diaphragms or microporous separators, forming a plurality of anolyte and catholyte compartments. The electrodes used in the cells are generally either monopolar or bipolar electrodes.

Membranes typically used in the cells are generally available in sheet form and have ion exchange properties, for example the membrane material employed in the cells are such as those marketed by E. I. duPont de Nemours and Company under the trademark Nafion ® and by Asahi Glass Company Ltd. under the trademark Flemion ®.

Typically, a press means is used to compress or clamp together the separators in sheet form between the sides of the frame members of the filter press cell and electrolyte is used to fill the compartments of the cell. Typically, to provide a fluid-tight seal between the frame members and the separator without damaging the separator, the electrolytic cells employ substantially flat, solid gaskets having a rectangular cross-sectional area or tubular type gaskets having a circular cross-sectional area made of elastomeric material. One or two gaskets can be used to fit between the cell frame members on a peripheral flange portion of the frame members and on either side of the membrane. While most gaskets, for the most part, can provide a liquid-tight seal, the seal is generally not completely fluid-tight, i.e. liquid and gas-tight. To some extent fluid (liquid and gas) seepage occurs at the interface formed between the membrane contacting the gasket members.

The problem of fluid seepage occurs particularly in cells which employ membrane separators that utilize a support or reinforcement material in the membrane. This reinforcement material is usually used because it provides a normally weak membrane with added strength for handling and installing into industrial size membrane filter press electrolytic cells. A problem associated with the use of support or reinforcement in membranes is that the reinforcement allows gases and liquids to seep from the inside of the operating cell to the exterior. This seepage can cause severe damage to the outer surface of the cell peripheral surface. Fluid seepage can also expose operating personnel to potentially hazardous chemicals. The problem of fluid seepage is aggravated by the use of pressurized cells operating under an internal electrode compartment pressure. The contemporary compression-seal means now being used by industry cannot significantly block the leakage of the liquids and gases in the electrolytic cells.

Another problem associated with the use of conventional gasketing of filter press cells is membrane drying. In a conventional membrane filter press type cell operation, the membrane is usually extended past the periphery of the cell and exposed to the environment. This exposure, in time, allows the membrane to dry and possibly crack. Any cracks formed in the exposed surface of the membrane can propagate, during operation of the cell, through the membrane to the portion of the membrane which is inside the cell, i.e., the operating area of the membrane, which in turn, can cause severe operation problems such as mixing of electrolytes that can cause corrosion of the cell's components or mixture of gases which can lead to explosions. Each situation can lead to the termination of the cell operation.

Still another problem associated with the assembly of filter press cells is, in addition to conventional gasketing, a separate and independent tentering device is normally needed to planarly dispose the membrane between the frame members of the cell. One conventional method of tentering the membrane involves personnel holding the membrane by hand between cell frames and stretching the membrane as the cell frames are compressed together The cell gaskets in this instance are glued or taped to one of the electrode frames. In another method, the cell frames, membranes and gaskets are assembled in the horizontal position to ensure a planar placement of the membrane and gaskets, and thereafter standing the assembled cell in the upright position for operation. Still another method, the membrane and gasket are glued or taped to the cathode or anode frame prior to assembling the elements of the cell together. These approaches are unsatisfactory as they present time consuming, complex procedures, costly equipment and safety hazards to personnel. These procedures may also allow the membrane to dry and crack and thereby render it unfit for operation.

It is, therefore, desired to provide a means suitable for sealing an electrolytic cell and tentering an electrolytic separator to reduce the complexity of assembling the elements of an electrolytic cell.

It is further desired to provide a solution to the above problems by providing a device and method for insuring that the outer boundaries of a membrane stay in a moist or wet state and by providing a device and method for containment and/or control of gas and liquid seepage from the internal cell structure at the membrane/gasket interface of a membrane filter press type cell.

SUMMARY OF THE INVENTION

One aspect of the present invention is a combination sealing means and membrane holding means for a filter press type electrolytic cell including a solid structure in a picture frame type configuration having an inside and outside perimeter surface, said solid structure having a groove in the outside perimeter surface forming a U-shaped member when viewed in cross section and adapted for holding the edges of a sheet-like member therein.

Another aspect of the invention is an electrolytic assembly containing the sealing and holding means above.

Yet another aspect of the invention is a method of sealing an electrolytic cell including compressing the sealing and holding member above with a separator between a first and second frame members together.

Still another aspect of the invention is a method of operating an electrolytic cell comprising:

(a) providing a sealing and holding member comprising a solid body structure in a picture frame type configuration having a groove therein forming a U-shaped member when viewed in cross-section, the bottom of the "U" of the U-shaped member forming the inside perimeter surface of the frame configuration and the "arms" of the U-shaped member forming the groove disposed toward the outside perimeter surface of the frame configuration, the groove adapted for holding the edges of a sheet-like member therein;

(b) inserting a sheet-like separator in the groove of the U-shaped seal member;

(c) interposing the seal member with separator between at least a first frame member and a second frame member, the separator spacing apart an anode and a cathode compartments defined by the first and second frame members and the separator;

(d) compressing the seal member with separator and the first and second frame members together;

(e) feeding an aqueous alkali metal halide solution to the electrolytic cell; and (f) passing an electrical current from the anode to the cathode such that a halide is evolved at the anode.

DETAILED DESCRIPTION OF THE PREFERRED EMBODIMENTS

Figure 1:
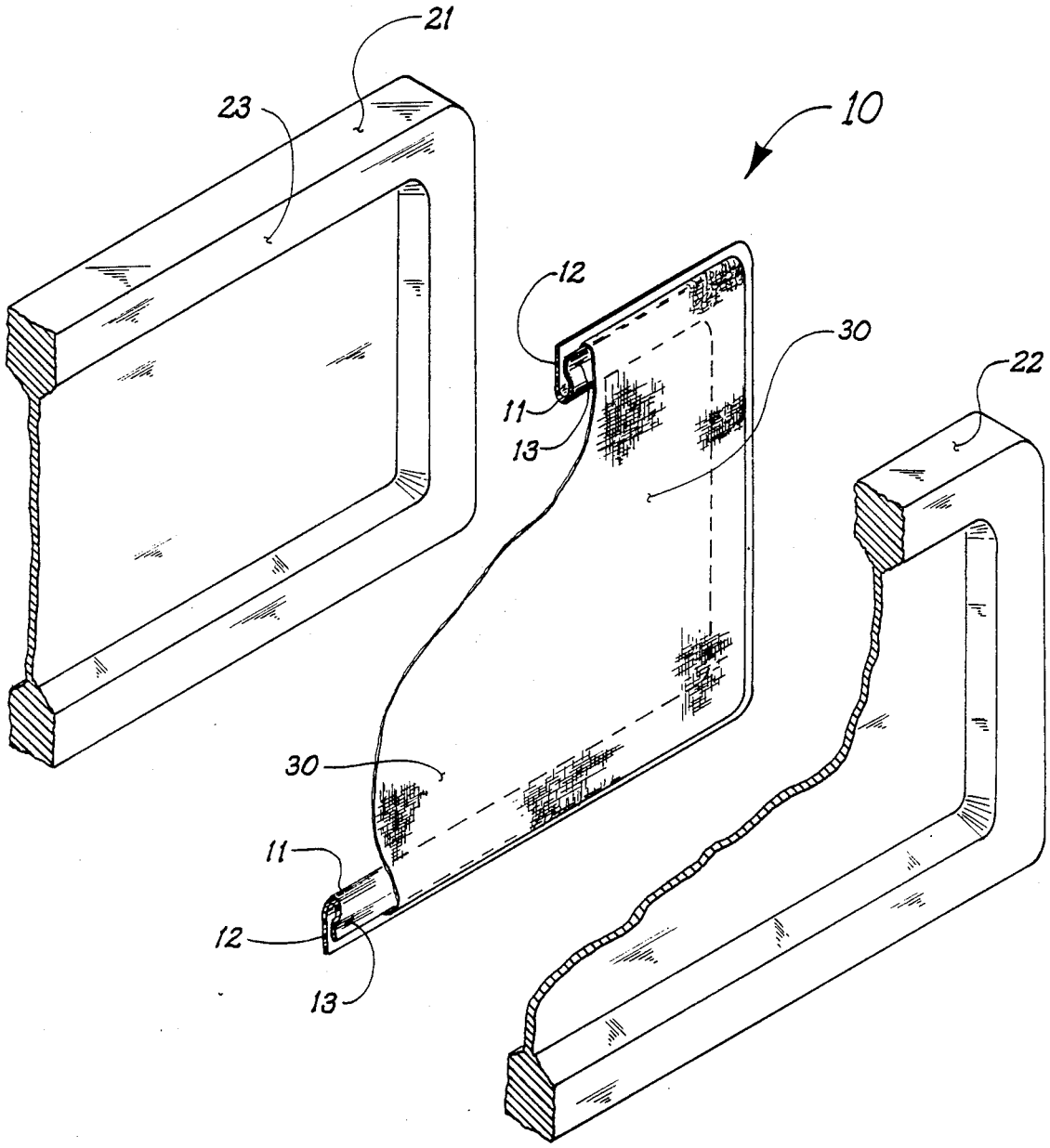
FIG. 1 is an exploded, partially broken away perspective view showing an electrolysis cell with a combination seal and holding member of the present invention with a membrane between two cell frames.
Figure 2:
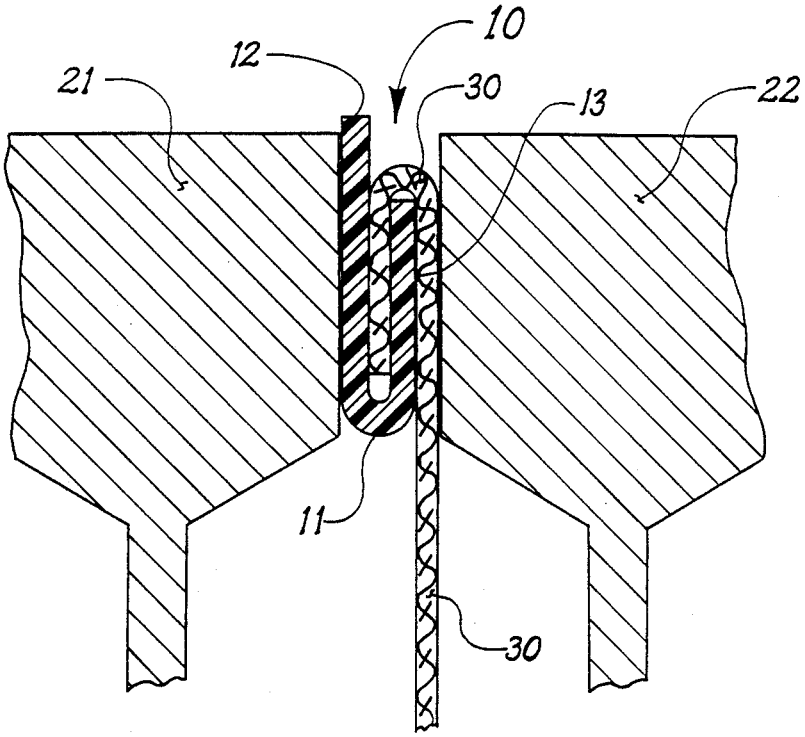
FIG. 2 is a cross section view showing a combination seal and holding member of the present invention with a membrane compressed between two cell frames.
Figure 3:
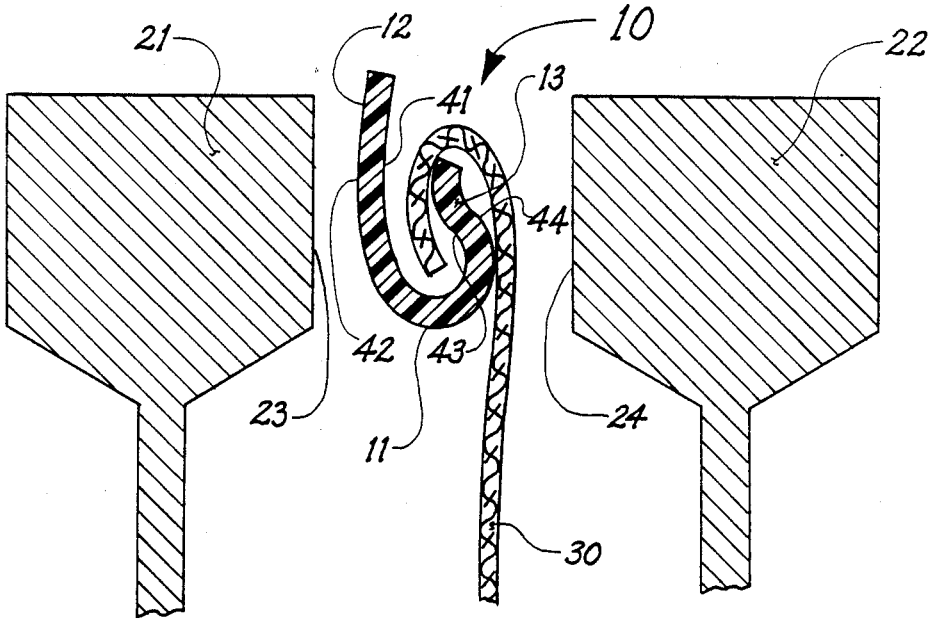
FIG. 3 is an exploded, cross sectional view of one embodiment of the invention shown in FIG. 1.

With reference to FIGS. 1, 2 and 3, there is shown a combination seal member and membrane holder member for an electrolysis cell of the filer press type, generally indicated by numeral 10, interposed between two electrolysis cell frame members 21 and 22. The combination seal member and membrane holder 10 will be referred to herein as the gasket member 10. However, it is understood that the gasket member 10 is utilized for the dual purpose of providing a seal for an electrolysis cell and a device for holding or retention of a membrane for an electrolysis cell.

The gasket member 10 comprises a solid body structure in a picture frame type configuration having a groove therein forming a U-shaped gasket member when viewed in cross-section having a bottom portion 11 and "arms" 12 and 13. Generally, one arm 13 is shorter in length than the other arm 12. The bottom portion 11 of the "U" of the U-shaped gasket member 10 forms the inside perimeter surface of the frame configuration and the arms 12 and 13 of the U-shaped gasket member forms the groove disposed toward the outside perimeter surface of the frame configuration and generally open to the atmosphere.

The groove of the gasket member 10 is adapted for holding the edge of a sheet-like member or separator, in this case a membrane member 30. The arms 12 and 13 of the U-shaped gasket member 10 are sized sufficient to hold a sufficient portion of the periphery or edges of the membrane member 30 within the gasket member 10, before installation into an electrolytic cell assembly, to secure the membrane 30 within the gasket member 10 under a compressive load.

One arm, in this case arm 12, of the U-shaped gasket member 10 contains inner surface 41 for contacting the edge of membrane 30 and outer surface 42 such that at least a portion of the outer surface 42 of the gasket member contacts at least a portion of the electrolysis cell frame 21 flange portion 23. The other arm, in this base arm 13, of the gasket member 10 contains an inner surface 43 for contacting the edge of the membrane 30 and an outer surface 44 for contacting at least a portion of the membrane 30 between arm 13 and the electrolysis cell frame 22 flange portion 24. The edge of the membrane 30 is wrapped around arm 13 to form an inverted U-shaped portion relative to the gasket member 10 such that only a small portion of the membrane 30 is adapted to remain outside the cell assembly and is not in contact with the cell frames, i.e., a portion of the membrane 30 extends over the peripheral edge of arm 13 of the gasket member 10. In another embodiment, the membrane could be extended over the peripheral edge of arm 13 instead of arm 12, if so desired. In still another embodiment, in compressing the gasket member 10, the portion of the arm 12 which extends above the membrane 30 can overlap the top portion of membrane 30 contacting the electrolysis frame 22 flange portion 24 whereby the membrane is substantially completely sealed from the atmosphere.

While not shown in the Figures of the present invention, there are various embodiments which will become apparent to one skilled in the art after reading the description herein. For example, the gasket member 10 of the present invention can include a plurality of ridges on the inner surface 41 and 43 to assist in holding the membrane 30 in place and providing additional compression load for sealing. The ridges can also be disposed on the outer surfaces 42 and 44 to increase compression loads at those points to improve sealability.

The gasket member 10 of the present invention should be made of an electrically insulating material. It is desirable that the gasket member 10 be flexible, and preferably resilient, in order to aid in achieving leak-tight seals in the electrolytic cell.

The gasket member 10 of the present invention should exhibit a high degree of resistance to corrosion by a variety of different electrolytes and products of electrolysis. However, the gasket member should show particular resistance to corrosion when the electrolyte which is electrolyzed is an aqueous solution of an alkali metal chloride, for example, an aqueous solution of sodium chloride. An aqueous solution of alkali metal chloride may be electrolyzed in a cell which comprises a separator between each anode and adjacent cathode. The gasket member should be resistant to wet chlorine produced during operation of such a cell.

The gasket member 10 is suitably made of an organic polymeric material which material may be, for example, a polyolefin e.g. polyethylene or polypropylene; a hydrocarbon elastomer, e.g. an elastomer based on ethylene-propylene copolymer, an ethylene-propylene-diene copolymer, natural rubber or a styrene-butadiene rubber; or a chlorinated hydrocarbon, e.g. polyvinyl chloride or polyvinylidene chloride. It is particularly desirable that the material of the gasket member be chemically resistant to the liquors in the electrolytic cell, and when the cell is to be used in the electrolysis of aqueous alkali metal chloride solution the material may be fluorinated polymeric material, for example polytetrafluoroethylene, polyvinyl fluoride, polyvinylidene fluoride, fluorinated ethylene-propylene copolymer: tetrafluoroethylene-hexa-fluoropropyl copolymer, or a substrate having an outer layer of such a fluorinated polymeric material.

Suitable as sealing means are gasket members comprised of elastomeric solids. Examples of the elastomeric solids include chlorobutadiene rubber (Neoprene), chlorosulfonated polyethylene (Hypalon), ethylene-propylene dimonomer (EPDM), or gum rubber.

The hardness of the gasket member 10 is not critical and any suitable hardness may be selected for the gasket member. Preferably, the gasket member has a low degree of hardness which allows the gasket members to fill in irregularities on the frame members and thus permit reduced tolerances which minimizes, for example, machining of metal electrolysis frame members and thus reduces production costs. For example, an elastomeric gasket member having a hardness of from about 50 durometer to about 90 durometer is suitable.

The thickness of the gasket member 10 is also not critical, but a suitable thickness should be selected for ease of manufacture of the gasket member used. For example, an elastomeric gasket member having a thickness of from about 1.5 mm to about 45 mm is suitable.

The gasket member 10 of the present invention may be used in any suitable filter press type electrolysis cell, the structure and function of its central components being well known to one of skill in the art. For example, an electrolytic cell of the filter press type comprising any number of alternating anodes and cathodes may be used. Electrolytic cells of the aforementioned types are used on a large scale for the production of chlorine and caustic alkali.

Preferred filter press electrolytic cells for employing the present invention are bipolar or monopolar membrane cells in which the electrodes are oriented generally vertically. Suitable bipolar filter press membrane electrolytic cell in which the gasket member may be used include, for example, those described in U.S. Pat. No. 4,488,946. Suitable filter press monopolar membrane electrolytic cells include those described in U.S. Pat. No. 4,056,458, issued Nov. 1, 1977, to G. R. Pohto et al.: U.S. Pat. No. 4,210,516, issued July 1, 1980, to L. Mose et al and U.S. Pat. No. 4,217,199, issued Aug. 12, 1980, to H. Cunningham.

The electrolytic cell comprises an anode or a plurality of anodes and a cathode or a plurality of cathodes, and one or more gasket members 10 of the present invention compressed together with a separator between each anode and adjacent cathode which divides the cell into separate anode and cathode compartments.

The electrolytic cell is equipped with means for charging electrolyte to the cell and with means for removing the products of electrolysis from the cell. In particular, the anode compartments of the cell are provided with means for feeding aqueous alkali metal chloride electrolyte to the cell, suitably from a common header, and with means for removing products of electrolysis from the cell. Similarly, the cathode compartments of the cell are provided with means for removing products of electrolysis from the cell, and optionally with means for feeding water on other fluid to the cell. The electrolysis process may be operated by charging electrolyte to the electrolytic cell, electrolyzing the electrolyte therein, and removing the products of electrolysis from the electrolytic cell.

The separator used in the electrolytic cell may be a hydraulically permeable diaphragm or a substantially hydraulically impermeable ionically-permselective membrane.

In an electrolytic cell equipped with a hydraulically-permeable microporous diaphragm and where an aqueous alkali metal chloride solution is electrolyzed in such a cell the solution is charged to the anode compartments of the cell and chlorine produced during electrolysis is removed therefrom, the solution passes through the diaphragm to the cathode compartments of the cell and hydrogen and aqueous alkali metal hydroxide solution produced by electrolysis are removed therefrom.

In an electrolytic cell equipped with an essentially hydraulically impermeable cationically-permselective membrane, aqueous alkali metal chloride solution is charged to the anode compartments of the cell and chlorine produced during electrolysis and depleted alkali metal chloride solution are removed from the anode compartments, alkali metal ions are transported across the membranes to the cathode compartments of the cell to which water or dilute alkali metal hydroxide solution may be charged, and hydrogen and alkali metal hydroxide solution produced by the reaction of alkali metal ions with hydroxyl ions are removed from the cathode compartments of the cell.

Preferably, inert flexible separators having ion exchange properties and which are substantially impervious to the hydrodynamic flow of the electrolyte and the passage of gas products produced in the cell are employed. Suitably used are cation exchange membranes such as those composed of fluorocarbon polymers having a plurality of pendant sulfonic acid groups or carboxylic acid groups or mixtures of sulfonic acid groups and carboxylic acid groups. The terms "sulfonic acid groups" and "carboxylic acid groups" are meant to include salts of sulfonic acid or salts of carboxylic acid which are suitably converted to or from the acid groups by processes such as hydrolysis. One example of a suitable membrane material having cation exchange properties is a perfluorosulfonio acid resin membrane composed of a copolymer of a polyfluoroolefin with a sulfonated perflurovinyl ether. A composite membrane sold commercially by E.I. duPont de Nemours and Company under the trademark Nafion ® is a suitable example of this membrane.

Another example of a suitable membrane is a cation exchange membrane using a carboxylic acid group as the ion exchange group. Carboxylic acid type cation exchange membranes are available commercially from the Asahi Glass Company under the trademark Flemion ®.

The electrodes have frames which have generally planar opposing surfaces such as flange surfaces 23 and 24 between which the gasket member 10 is compressed. The frames are generally of a thick solid construction capable of withstanding the considerable compressor force exerted upon the frames when the filter press cell is assembled. To prevent the gasket members from "popping out" under compression, the frames should be substantially flat. To avoid the considerable expense of machining and finishing, the opposing planar surfaces are free of recesses or grooves However, the frames may contain a recess therein for receiving a second gasket member, such as an 0-ring member, for sealing the flange portions of the electrolytic cells.

Electrode frame components may be in the shape of rectangular bars, C or U channels, cylindrical tubes, elliptical tubes as well as being 1-shaped or H-shaped. Preferably, the frame components are in the shape of an I-shaped cross section as shown in FIG. 1.

The materials of construction for frame components may be any which are resistant to corrosion by the electrolytes and the products of electrolysis. For example, metal anode frames used in the electrolysis of alkali metal chlorides are constructed of valve metals such as titanium, tantalum, or tungsten and their alloys, with titanium being preferred. Cathode frames may be constructed of metals such as iron, steel, stainless steel, nickel, or alloys of these metals may be used as well as plastic materials such as polypropylene, polybutylene, polytetrafluoroethylene, FEP, and chlorendic acid based polyesters.

During assembly of the filter press electrolytic cell, pressing means such as tie bolts tightened around the perimeter of the cell or hydraulic cylinders pressing against a mobile platen against the cell frame members is used. The pressing means bonds the individual electrodes, anodes, and cathodes alternately arranged, together. An adjacent electrode pair, a cathode and an anode, are compressed together so that the gasket member with the membrane held therein is compressed. The electrodes are separated by the individual gasket member which is inserted therebetween which contains the membrane within the groove of the gasket members. As the electrodes are compressed together by the application of a suitable closure force, the gasket member deforms in a manner which effects a fluid-tight seal between adjacent electrode frames, as well as securing the membrane along the inside surface of the gasket member to avoid any undesired slippage.

What is claimed is:

1. A combination electrolysis cell sealing means and separator holding means for a filter press type electrolytic cell comprising:

a solid body structure in a picture frame type configuration having a groove therein forming a U-shaped member when viewed in cross-section, the frame configuration having an inside perimeter surface and an outside perimeter surface, the bottom of the U-shaped member forming the inside perimeter surface of the frame configuration and the "arms" of the U-shaped member forming the groove disposed toward the outside perimeter surface of the frame configuration, the groove being adapted for (a) holding the edge of a sheet-like separator member therein prior to installation of the solid body structure into an electrolytic cell and (b) securing the separator member and sealing the electrolytic cell upon application of a compressive load to the solid body structure.

2. The combination of claim 1 wherein one arm of the U-shaped member is shorter than the other.

3. The combination of claim 2 wherein the separator member is wrapped over the shorter arm of the U-shaped member.

4. The combination of claim 1 including ridges on the inside surface of the U-shaped member.

5. The combination of claim 1 including ridges on the outside surface of the U-shaped member.

6. A cell assembly comprising at least two frame members, a separator member and a combination sealing and holding means of claim 1.

7. A method of sealing an electrolytic cell comprising:

(a) providing a seal member comprising a solid body structure in a picture frame type configuration having a groove therein forming a U-shaped member when viewed in cross-section, the bottom of the "U" of the U-shaped member forming the inside perimeter surface of the frame configuration and the "arms" of the U-shaped member forming the groove disposed toward the outside perimeter surface of the frame configuration, the groove adapted for holding the edges of a sheet-like member therein:

(b) inserting a sheet-like separator in the groove of the U-shaped seal member;

(c) interposing the seal member with separator between at least a first frame member and a second frame member, the separator spacing apart an anode and a cathode compartments defined by the first and second frame members and the separator; and (d) compressing the seal member with separator and the first and second frame members together.

8. A method of operating an electrolytic cell comprising:

(a) providing a seal member comprising a solid body structure in a picture frame type configuration having a groove therein forming a U-shaped member when viewed in cross-section, the bottom of the "U" of the U-shaped member forming the inside perimeter surface of the frame configuration and the "arms" of the U-shaped member forming the groove disposed toward the outside perimeter surface of the frame configuration, the groove adapted for holding the edges of a sheet-like member therein:

(b) inserting a sheet-like separator in the groove of the U-shaped seal member;

(c) interposing the seal member with separator between at least a first frame member and a second frame member, the separator spacing apart an anode and a cathode compartments defined by the first and second frame members and the separator;

(d) compressing the seal member with separator and the first and second frame members together;

(e) feeding an aqueous alkali metal halide solution to the electrolytic cell; and (f) passing an electrical current from the anode to the cathode such that a halide is evolved at the anode.

9. A combination electrolysis cell sealing means and separator holding means for a filter press type electrolytic cell comprising:

a solid body structure in a picture frame type configuration having a groove therein forming a U-shaped member when viewed in cross-section, the frame configuration having an inside perimeter surface and an outside perimeter surface, the bottom of the U-shaped member forming the inside perimeter surface of the frame configuration, the "arms" of the U-shaped member forming a groove disposed toward the outside perimeter surface of the frame configuration, one of the arms being shorter than the other arm, the groove having ridges on the inside surface thereof and adapted for holding the edge of a sheet-like separator member therein, the edge being wrapped over the shorter arm of the U-shaped member.

10. The combination of claim 9 including ridges on the outside surface of the U-shaped member.

11. A cell assembly comprising at least two frame members, a separator member and a combination sealing and holding means of claim 9.

* * * * *

UNITED STATES PATENT AND TRADEMARK OFFICE

CERTIFICATE OF CORRECTION

PATENT NO. : 4,940,518

DATED : July 10, 1990

INVENTOR(S) : Gregory J. E. Morris

It is certified that error appears in the above-identified patent and that said Letters Patent is hereby corrected as shown below:

Column 4, line 12, --base-- should read "case".

Column 5, line 5, --copolymer:-- should read "copolymer;".

Column 6, line 43, --perfluorosulfonio-- should read "perfluorosulfonic".

Column 6, line 59, --compressor-- should read "compression".

Column 6, line 65, --grooves However-- should read "grooves. However".

Column 7, line 3, --1-shaped-- should read "I-shaped".

Column 8, line 11, --therein:-- should read "therein;".

Signed and Sealed this

Nineteenth Day of May, 1992

*Attest:*

DOUGLAS B. COMER

*Attesting Officer*

*Acting Commissioner of Patents and Trademarks*